United States Patent [19]

Schreckendgust

[11] 4,196,460

[45] Apr. 1, 1980

[54] MAJOR SURGICAL LIGHT

[75] Inventor: Jay G. Schreckendgust, Victor, N.Y.

[73] Assignee: Sybron Corporation, Rochester, N.Y.

[21] Appl. No.: 924,629

[22] Filed: Jul. 14, 1978

[51] Int. Cl.[2] ..... F21V 9/00

[52] U.S. Cl. ..... 362/231; 362/2; 362/295; 362/804

[58] Field of Search ..... 362/2, 16, 18, 166–168, 362/210, 230, 231, 265, 295, 367, 802, 804

[56] References Cited

U.S. PATENT DOCUMENTS

| | | | |
|---|---|---|---|
| 2,249,610 | 7/1941 | James et al. | 362/231 X |
| 2,846,566 | 8/1958 | Gunther et al. | 362/295 X |
| 3,360,640 | 12/1967 | Seitz et al. | 362/804 X |
| 3,425,146 | 2/1969 | Winstanley | 362/231 X |
| 3,588,488 | 6/1971 | Lauterbach | 362/804 X |
| 3,721,850 | 3/1973 | Giller | 362/351 X |
| 3,805,049 | 4/1974 | Frank et al. | 362/231 X |
| 3,825,335 | 7/1974 | Reynolds | 362/18 X |
| 4,072,856 | 2/1978 | Eligehausen | 362/2 |
| 4,104,709 | 8/1978 | Kloots | 362/804 X |
| 4,125,888 | 11/1978 | Tsuchihashi et al. | 362/231 X |

*Primary Examiner*—Peter A. Nelson

*Attorney, Agent, or Firm*—Theodore B. Roessel; Roger Aceto

[57] ABSTRACT

A major surgical light has a plurality of light sources which permit both color and size adjustment of the illumination pattern. Color variation is accomplished by increasing the intensity of a light source of one color value while decreasing the intensity of a light source of another color value. Size adjustment is accomplished by providing two light sources, each casting different diameter light patterns which are superimposed on the work area. The intensity of one light source is increased while the other is decreased so as to vary the size of the pattern.

11 Claims, 3 Drawing Figures

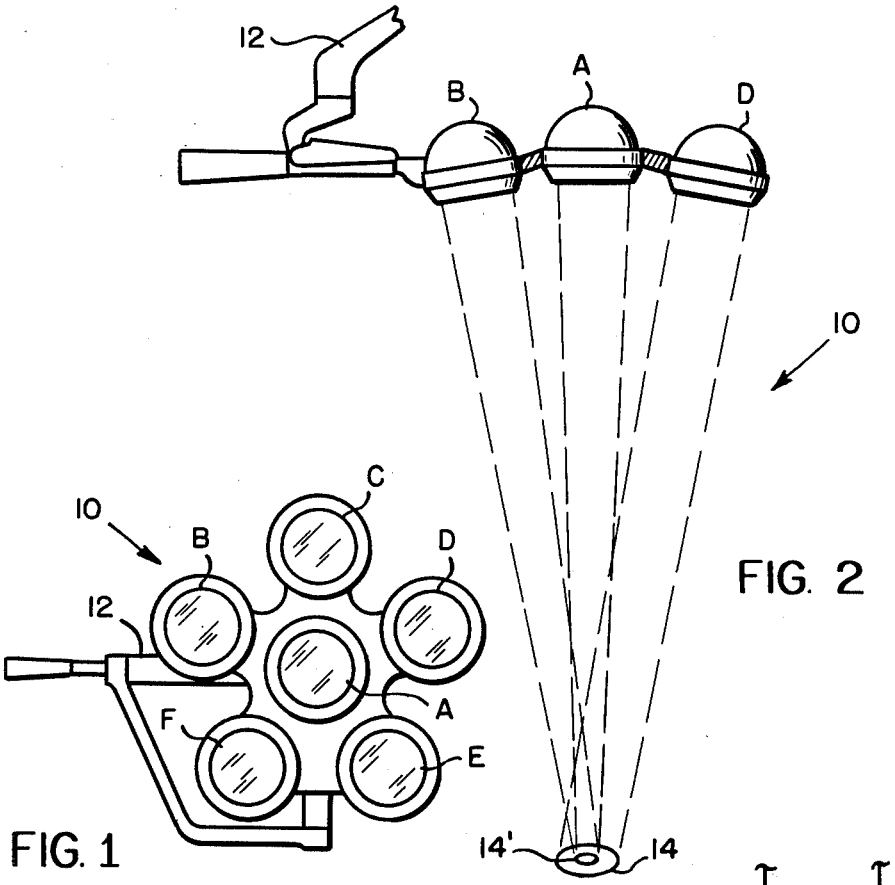
FIG. 2
FIG. 1
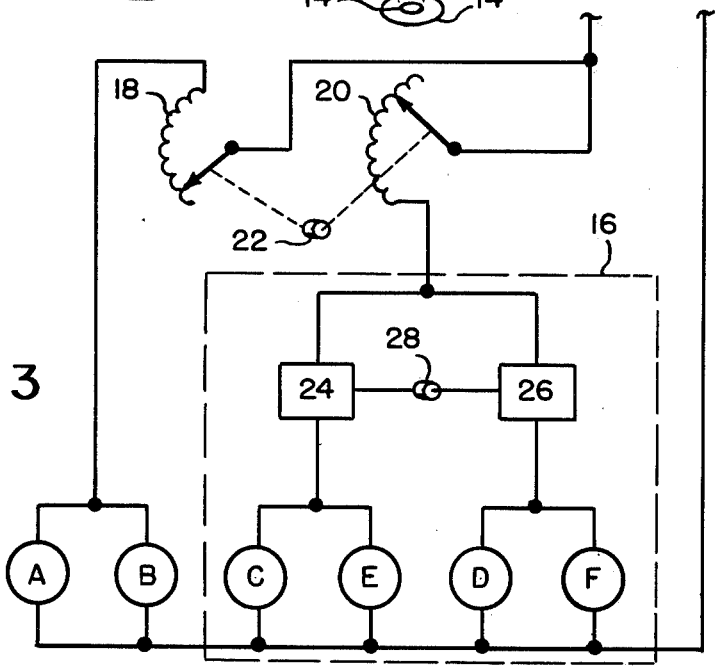
FIG. 3

MAJOR SURGICAL LIGHT

TECHNICAL FIELD

The present invention relates generally to a lighting system and more particularly to a surgical lighting system in which color and pattern size can be adjusted.

Both color and intensity of illumination are recognized as important factors in the illumination of any surgical site. This is particularly true of a major surgical site where the surgeon may penetrate the body to a considerable depth.

For example, accurate perception of color is essential to the efficient performance of the critical tasks encountered in surgery since the color of tissue may often be an important diagnostic factor. Surgical lighting systems are commonly color corrected to a level within approximately 3500°–6700° K. so as to approach the quality of sunlight. However, such a set color temperature is only a compromise situation and may not necessarily be the most appropriate color distribution to best satisfy a given surgical task.

Likewise, pattern size or intensity distribution of the light pattern over the surgical site is another critical factor. "Pattern" as used herein is intended to describe an illuminated area within which the level of illumination tapers from center to edge so that at the edge of the area, the intensity is no less than 20% of the intensity at the center of the area.

Delicate surgical procedures require a uniform pattern of illumination of a relatively high intensity. However, intense illumination of an area greater than the specific surgical site may inhibit the surgeon's performance as well as contribute to his fatigue. Accordingly, it is desirable to limit high intensity illumination essentially to the important areas of the surgical procedure.

Current surgical light systems either do not adjust the overall size of the pattern or provide a relatively uniform pattern which is defocused mechanically into a relatively non-uniform pattern of a different size.

SUMMARY OF THE INVENTION

In the present invention, a surgical lighting system is provided which allows a surgeon to select both color and pattern size within an available range to best suit the particular surgical task being performed. In this respect, a plurality of light sources are provided for illuminating the surgical site. Variable color selection is based on the principle that the illumination produced by super positioning two or more light patterns is equal to the sum of the illuminations produced separately. Thus the surgical lighting system of the present invention has at least two light sources, each producing light at a different color temperature. The intensity of one source is increased while the other is decreased so as to provide a resulting illumination of continually variable color.

The pattern size of the most intensely illuminated area is likewise based on the principle that the intensity of the illumination produced by super positioning the patterns of two or more light sources is equal to the sum of the intensities produced separately by each source. Thus the lighting system of the present invention has a least two light sources, each producing a different diameter pattern which are concentric and superimposed. The size of the resulting pattern is then increased or decreased by increasing the intensity of one light source while decreasing the other.

DESCRIPTION OF THE DRAWINGS

FIG. 1 is a plan view of the surgical light of the present invention;

FIG. 2 is a side elevation view of the light as shown in FIG. 1; and

FIG. 3 is an electrical schematic showing the controls for varying pattern size and color.

DESCRIPTION OF THE PREFERRED EMBODIMENTS

Referring to the drawings, FIGS. 1 and 2 show the surgical light of the present invention generally indicated at 10. The light includes a mounting arm 12 for adjustably suspending the light source from the ceiling of a surgical operatory. The arm carries a plurality of light sources or pods arranged so that the light emitted from each source falls in concentric patterns on the illuminated surface to form a single pattern. In the embodiment as shown in FIGS. 1 and 2, the six light sources or pods provided are identified by the letters A–F. However, it should be appreciated that the invention as described herein can be practiced by as few as three separate light sources.

Each of the light sources or pods A to F are generally constructed along the lines of the light source described in U.S. Pat. No. 3,588,488 and the arrangement of the pods into one surgical light is disclosed generally in U.S. Pat. No. Des. 214,188.

Normally in a major surgical light of the type described, each of the light sources or pods A to F would be color corrected to the same color temperature. However, in the present invention, the pods are arranged in pairs with each pair producing light of a different color temperature. Thus, in the system shown in FIG. 1, pods A and B produce light having a color temperature of approximately 4700° K., pods D and F produce light at about 3500° K. and pods C and E produce light at approximately 7000° K. Since the light from each pod A to F falls on the same general spot the color temperature of the resulting pattern would be a mixture of the color values produced by each of the pairs of the pods A–B, D–F, and C–E. Moreover, if the intensity of the pair A–B were held constant, the color temperature of the resulting pattern could be varied from about 4000° K. to 6500° K. by simply increasing or decreasing the intensity of the colored pairs, namely, C–E and D–F.

In another aspect of the invention, as shown in FIG. 2, the means for adjusting the size of the pattern is accomplished by having the light from pods C, D, E, and F focused to a pattern size indicated at 14 while the light from pods A and B is focused to a smaller diameter pattern indicated at 14'. Since the intensity of illumination is additive, the resulting pattern will have a size which can be continuously varied in proportion to the contribution of each of the light sources, namely, C, D, E and F on the one hand, which produce the larger diameter pattern 14, and the sources A and B on the other hand, which produce the concentric smaller pattern 14'. Thus, by varying the intensities of lights A and B on the one hand and C, D, E and F on the other, the size of the light pattern on the surgical site can be continuously varied in size from the smallest diameter pattern indicated at 14' to the larger diameter pattern indicated at 14.

Referring to FIG. 3, the electrical schematic is shown with portions for controlling both color and size variation of the pattern. The color variation portion of the schematic is enclosed within the phantom line portion indicated at 16. Since all of the pods C, D, E and F included within phantom line 16 produce the same size pattern, these will be treated as one light source for purposes of describing the means for varying the pattern size. Likewise, light sources A and B produce the same pattern size, so they will be considered as a single source when describing the means for changing the pattern size.

Varying the size of the light pattern between the limits 14' and 14, as shown in FIG. 2, is accomplished simply by increasing the light intensity of the light source made up of pods C, D, E and F while decreasing the intensity of the light source made up of pods A and B; or visa versa. To accomplish this, two variacs 18 and 20 are ganged so that operation of a control knob 22 will decrease the voltage supplied from one variac, while increasing the voltage supplied from the other. Variacs 18, 20 are connected in parallel. In addition, variac 18 is connected in series with the filaments of light sources A and B whereas variac 20 is connected in series with the filaments of light sources C, D, E and F. Accordingly, rotation of the single knob 22 will increase the intensity of one or another of the light sources while decreasing the other. As set forth hereinabove, this would have the effect of changing the diameter of the most intensely illuminated pattern between the limits represented by references 14 and 14'.

The variation in color is accomplished by the portion of a schematic contained within the phantom line 16. In this respect the output from variac 20 is fed, in parallel, to two solid state dimmer controls 24 and 26. The shafts of the variable resistors of these two dimmer controls have been geared together so upon a rotation of the knob 28, the voltage output of one dimmer will increase, while the other will decrease. The output voltage of dimmer 24 when applied to the filaments of light sources C and E controls the intensity of the light pair C–E whereas the output of dimmer 26 when applied to the filaments of light sources D and F controls the intensity of the light pair D–F. Accordingly, by rotating knob 28, the intensity of the light at 7000° K. (pods C–E) can be increased or decreased while the intensity of the light at 3500° K. (pods D–F) is respectively decreased or increased. This varying intensity is superimposed on the pattern produced by light pair A–B at approximately 4700° K. The net result is a variation in the color of the pattern between about 4000° K. and 6500° K.

It should be appreciated that it is important that the light intensity at pattern 14 should remain nearly constant, while the color distribution is being continuously changed. This requires that as the light intensity or output from one set of pods (C–E or D–F) is increased, the intensity of the other set should be decreased by a like amount. However, in the case where tungsten lamps are used, it is well-known that the light intensity produced by a tungsten filament does not vary linearly with applied voltage.

For example, and by way of illustration only, the relationship of the voltage applied to a tungsten filament and the resulting light output is given in Table I below:

TABLE I

| % Filament Voltage | % Light Output |
|---|---|
| 100 | 100 |
| 80 | 49 |

TABLE I-continued

| % Filament Voltage | % Light Output |
|---|---|
| 60 | 17 |
| 40 | 4 |

Various means could be used to compensate for this non-linear characteristic of tungsten filaments. For example, a non-linear gear between controls 24, 26 or an electrical compensating circuit between dimmer controls 24, 26 and the filaments could be used to vary the voltage applied to the appropriate filament by a non-linear amount sufficient to insure a linear relationship of the light output.

However, it has been found that the inherent characteristics of dimmer controls 24, 26 can be used to provide the necessary compensation. This will allow use of a simple pinion gear between the dimmer controls to provide a simultaneous opposite and equal rotation of the dimmer controls.

In this respect, it is known that the voltage output of a conventional solid state dimmer control varies in a non-linear manner as the control is rotated from a "full on" to a "full off" position. For example, and by way of illustration only, the dimmer when "full on" (360° of rotation) has a maximum output voltage (100%). However, rotation to only, say 80% of "full on", that is 288°, may result in a voltage output of 94% of maximum.

Accordingly, it has been found that this non-linear characteristic of the solid state controllers 24 and 26 can be used to compensate for the non-linear characteristics of the tungsten filament, in order to increase and decrease the light output of pods C–E on the one hand and pods D–F on the other. It has been found emperically that such compensation occurs with a linearity deviation of only plus or minus 10% when the adjustment or rotation of conventional solid state dimmers 24 and 26 is limited to about 100° of rotation from 260° to 360°. Thus, with one dimmer control at the "full on" position (360° of rotation), the other will be at its minimum position of about 72% of "full on" (260° of rotation).

Any rotation of knob 28 to increase the voltage output of one dimmer control will decrease the voltage output of the other dimmer control, the increase and decrease of the voltage outputs being in a non-linear fashion due to the characteristics of solid state dimmer controls as described above. This non-linear variation of voltage outputs is such that when applied to the tungsten filaments, it will produce a linear variation of the light output of these filaments.

Thus, it should be appreciated that the present invention provides a major surgical light having the capability of both pattern size and color adjustments so that the surgeon can quickly and easily select the pattern size and color best suited to the surgical procedure being performed.

I claim:

1. A surgical light for illuminating a surgical site with a pattern that is adjustable in both size and color, said light comprising:

(a) a first light source producing a light pattern of a first given diameter and color;

(b) a second light source producing a light pattern of a second given diameter and color;

(c) a third light source producing a light pattern having said second given diameter and of a third given color;

(d) a support for said light sources, each of said light sources being fixed relative to said support and to each other and being arranged on said support so that the light patterns from said three light sources are concentric and superimposed at the surgical site to produce a single light pattern;

(e) color adjusting means increasing and decreasing the intensity of said second light source while simultaneously decreasing and increasing respectively the intensity of said third light source for changing the color of said single light pattern; and (f) size adjusting means increasing and decreasing the intensity of said first light source while simultaneously decreasing or increasing respectively the intensity of said second and third light sources for changing the diameter of said single light pattern between the limits of said first and second given diameters.

2. A surgical light as in claim 1 wherein said size adjusting means comprises means for varying in an inverse relationship the voltage supplied to said first light source on the one hand and the voltage supplied to said second and third sources on the other hand.

3. A surgical light as in claim 1 wherein said light sources include tungsten filaments and said size adjusting means comprises:

(a) a first circuit portion including the filament of said first light source and a first voltage control means for varying the voltage supplied to the filament of said first light source;

(b) a second circuit portion in parallel with said first circuit portion, the filaments of said second and third light sources being connected in parallel in said second circuit portion;

(c) second voltage control means in said second circuit portion for varying the voltage supplied to the filaments of said second and third light sources; and (d) said first and second voltage control means being interconnected so that increasing the voltage output of one decreases the voltage output of the other.

4. A surgical light as in claim 3 wherein said first and second voltage control means are ganged variacs.

5. A surgical light as in claim 1 wherein said color adjusting means comprises means for varying in an inverse relationship the voltages supplied to said second and third light sources.

6. A surgical light as in claim 1 wherein said light sources include tungsten filaments and said color adjusting means varies the voltage applied to said filaments.

7. A surgical light as in claim 6 wherein said color adjusting means includes a compensator to vary the voltage applied to said filaments in a non-linear fashion so as to produce a linear variation control of the intensity of said second and third light sources.

8. A surgical light as in claim 7 wherein said color adjusting means comprise a pair of solid state dimmer controls and means interconnecting said controls to increase the voltage output of one of said solid state dimmer controls while decreasing the voltage output of the other.

9. A surgical light as in claim 1 wherein said first, second and third light sources each comprise a pair of lights with individual lights being arranged at spaced intervals about said support.

10. A surgical light comprising:

(a) a support;

(b) a first light source mounted on said support and arranged to produce an illuminated spot of a first given diameter;

(c) a second light source mounted on said support and arranged to produce an illuminated spot of a second given diameter, the illuminated spot from said second light source being superimposed on and concentric with said spot from said first light source;

(d) said first and second light sources being fixed relative to said support and to each other; and (e) control means for varying in an inverse relationship the intensity of said light sources so as to increase the intensity of one of said light sources while decreasing the intensity of the other, whereby the diameter of the area of maximum illumination produced by said concentric, superimposed spots can be varied in size between the limits of said first and second diameters.

11. A surgical light as in claim 10 wherein said first light source is a pair of colored lights each producing light of a different color temperature from each other and from said second light source and means operating independently of said control means for increasing the intensity of one colored light of said pair while decreasing the intensity of other.

* * * * *